US012540011B2

(12) United States Patent
Huang

(10) Patent No.: US 12,540,011 B2
(45) Date of Patent: Feb. 3, 2026

(54) RECYCLABLE TAKEAWAY CUP

(71) Applicant: Chun-Hung Huang, Changhua County (TW)

(72) Inventor: Chun-Hung Huang, Changhua County (TW)

( * ) Notice: Subject to any disclaimer, the term of this patent is extended or adjusted under 35 U.S.C. 154(b) by 163 days.

(21) Appl. No.: 18/582,053

(22) Filed: Feb. 20, 2024

(65) Prior Publication Data

US 2025/0263203 A1 Aug. 21, 2025

(51) Int. Cl.

*B65D 25/46* (2006.01)
*B65D 43/16* (2006.01)
*B65D 43/24* (2006.01)

(52) U.S. Cl.

CPC ..... *B65D 25/465* (2013.01); *B65D 43/162* (2013.01); *B65D 43/24* (2013.01); *B65D 2547/066* (2013.01)

(58) Field of Classification Search

CPC .... B65D 47/065; B65D 47/06; B65D 47/066; B65D 75/5883; B65D 25/465; B65D 43/162; B65D 43/24; B65D 2547/066

See application file for complete search history.

(56) References Cited

U.S. PATENT DOCUMENTS 4,291,814 A * 9/1981 Conn ..... B65D 77/28 215/229
4,415,312 A * 11/1983 Brenneman ..... F03D 7/06 416/139
5,465,866 A * 11/1995 Belcastro ..... A47G 19/2272 220/709
8,939,312 B1 * 1/2015 Buck ..... B65D 81/3205 220/709
2013/0119065 A1 * 5/2013 Buck ..... A47G 19/2205 220/523
2022/0265030 A1 * 8/2022 Wittig ..... A47G 19/2255

* cited by examiner

*Primary Examiner* — Shawn M Braden
(74) *Attorney, Agent, or Firm* — LANWAY IPR SERVICES; Chun-Ming Shih

(57) ABSTRACT

A recyclable takeaway cup contains: a body, a lid, and a flexible connection unit. The body includes a lower edge, an enlarged fringe, a mouth, a recessed face, and an inlet defined. The body and the lid are one-piece connected via the flexible connection unit, and the flexible connection unit is bendable in a U shape so that the lid is covered on the mouth of the body. The lid includes a surround fence configured to cover the mouth, a platform formed on a top of the surround fence, an opening defined on the platform, corresponding to the conduit and configured to receive the sucking element. The sucking element is removable and hollow so that when the lid is covered on the mouth of the body, the sucking element is inserted into a top of the conduit to suck content in the body.

5 Claims, 5 Drawing Sheets

RECYCLABLE TAKEAWAY CUP

TECHNICAL FIELD

The present invention relates to a recycle container, and more particularly to a recycle takeaway cup which contains a body and a cup one-piece molded with the body so as to suck ingredients in the body via a sucking element without using a straw made of plastic.

BACKGROUND

In the past few decades, sellers of beverage industry have provided consumers with disposable cups (such as paper cups or plastic cups) for internal use or take-out. However, it has resulted in alarming plastic pollution and garbage. In recent years, the government has expanded plastic reduction policies and hopes that consumers will bring their own beverage cups, thermos cups and other containers to hold the purchased tea and coffee. But, beverage cups or thermos cups are sometimes not convenient to carry. Therefore, some sellers have discovered business opportunities and provided a product service of carrying cups for recycling.

Recyclable takeaway cups (also called "recycling cups or loan cups") are reusable cups provided by the sellers for consumers to fill with drinks and then return them to a specific recycling place within a certain period of time after use (such as chain stores). The used cups will be cleaned by professional manufacturers and will be reused next time. No plastic cups or paper cups will be used in the process, and consumers will also enjoy the convenience of buying drinks on the go.

The portable cup is mainly comprised of a cup body and a lid. After returning it, consumers need to put the body and lid into the recycling bin respectively. Then, the operator will carry the body and lid back to wash, sterilize, dry and package them separately. Accordingly, takeaway cups are not environmentally friendly in terms of cleaning, wasting water, electricity, and packaging materials. In addition, when there are ingredients (such as rice balls, pudding, jelly, etc.) in the drink, it is required to insert a straw to absorb the ingredients.

The present invention has arisen to mitigate and/or obviate the afore-described disadvantages.

SUMMARY

The primary aspect of the present invention is to provide a recyclable takeaway cup which contains the body and the lid one-piece molded with the body to simplify structure and cleaning and to reduce water, power and material consumption.

Secondary aspect of the present invention is to provide a recyclable takeaway cup which contains the body and the lid one-piece molded with the body to suck the drinks and ingredients directly via a sucking element without using a straw made.

Further aspect of the present invention is to provide a recyclable takeaway cup which is portable conveniently.

To obtain above-mentioned aspects, a recyclable takeaway cup provided by the present invention contains: a body, a lid, and a flexible connection unit.

The body includes a lower edge, an enlarged fringe extending upward from the lower edge, a mouth formed on a top of the enlarged fringe, a conduit defined on an inner wall of the enlarged fringe, a recessed face formed on the enlarged fringe beside two ends of the conduit, and an inlet defined between the conduit and the lower edge.

The body and the lid are one-piece connected via the flexible connection unit, and the flexible connection unit is bendable in a U shape so that the lid is covered on the mouth of the body. A first end of the flexible connection unit is connected on a bottom of the mouth, and a second end of the flexible connection unit is connected on a bottom of the lid.

The lid includes a surround fence configured to cover the mouth, a platform formed on a top of the surround fence, an opening defined on the platform, corresponding to the conduit and configured to receive the sucking element. The sucking element is removable and hollow so that when the lid is covered on the mouth of the body, the sucking element is inserted into a top of the conduit to suck ingredients in the body.

Preferably, the recessed face has a first tilted connection portion formed on a top thereof and extending upward to the enlarged fringe.

Preferably, the recessed face has a second tilted connection portion formed on a bottom thereof and extending to the lower edge. The inlet is defined on a center of the second tilted connection portion.

Preferably, the conduit has a window fixed adjacent to the enlarged fringe and made of transparent or translucent material.

Preferably, the sucking element includes a bendable flexibility sheet connected thereon, a plug connected on an end of the bendable flexibility sheet and configured to close the sucking element. The platform has a lower portion, a high portion, a beveled coupling face configured to connect the lower portion with the high portion, and an air orifice defined on the beveled coupling face. The bendable flexibility sheet has a head formed on a predetermined position thereof and configured to be received in the orifice. The high portion has an arcuate receiving portion configured to receive the plug, when removing the plug from the sucking element.

Preferably, the body, the lid, and the flexible connection unit are one-piece molded by a plastic mold.

Accordingly, the recyclable takeaway cup has advantage as follows:

1) The recyclable takeaway cup is one-piece molded to obtain easy recycling without removal, thus increasing using willingness and saving water and power consumption while cleaning the recyclable takeaway cup (such as in washing, drying and sterilizing process).
2) The recyclable takeaway cup includes the sucking element received therein to enhance using convenience while sucking the ingredients (such as rice balls, jelly, pudding or konjac) in the body.
3) The conduit has a window fixed adjacent to the enlarged fringe of the body so that the ingredients in the body are viewable via the window, thus enhancing drinking pleasure.

DETAILED DESCRIPTION

With reference to FIGS. 1-4, a recyclable takeaway cup according to a preferred embodiment of the present invention comprises: a body 10, a lid 20, a flexible connection unit 30, and a sucking element 40.

Figure 1:
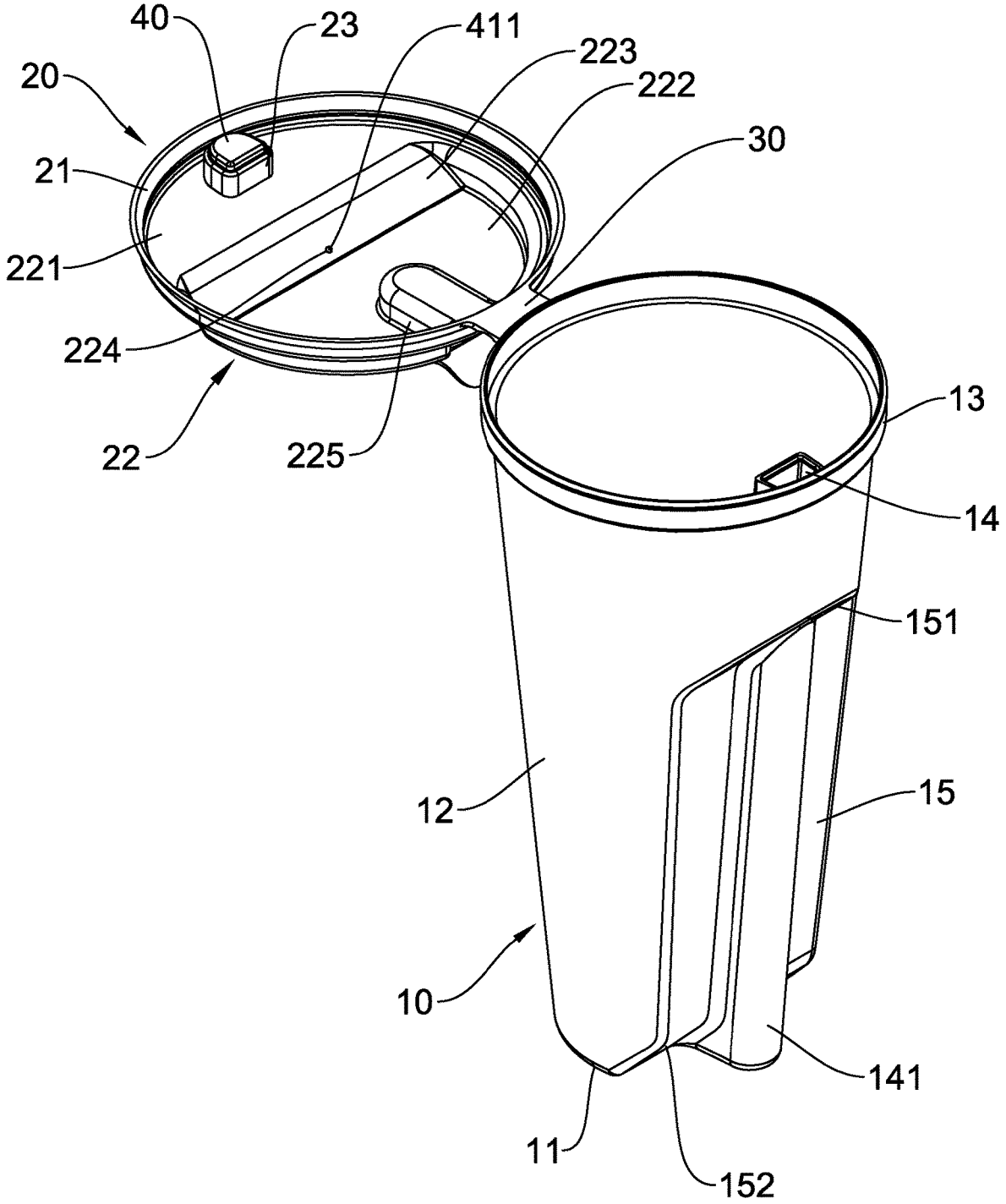
FIG. 1 is a perspective view showing the assembly of a recyclable takeaway cup according to a preferred embodiment of the present invention.
Figure 2:
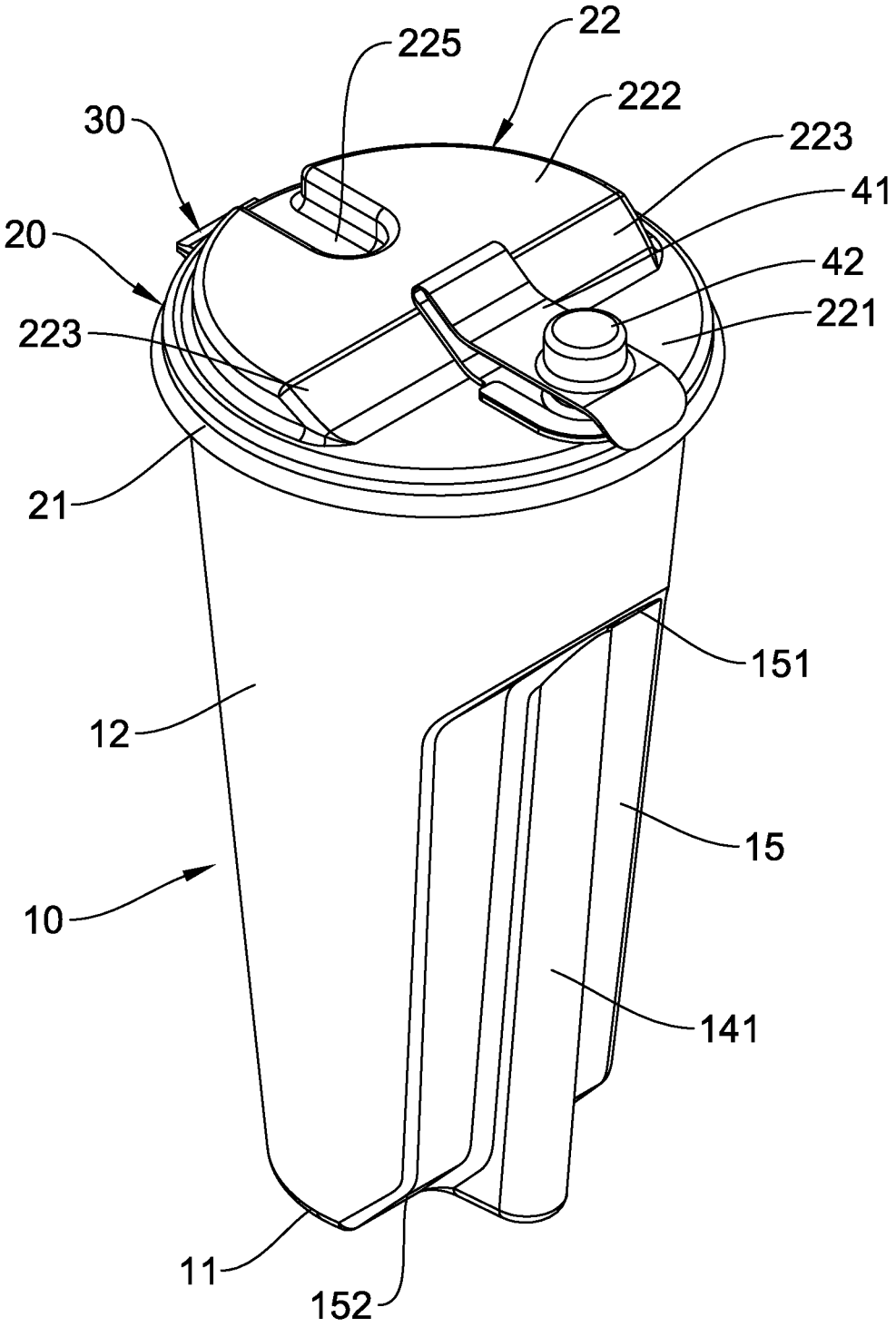
FIG. 2 is another perspective view showing the assembly of the recyclable takeaway cup according to the preferred embodiment of the present invention.
Figure 3:
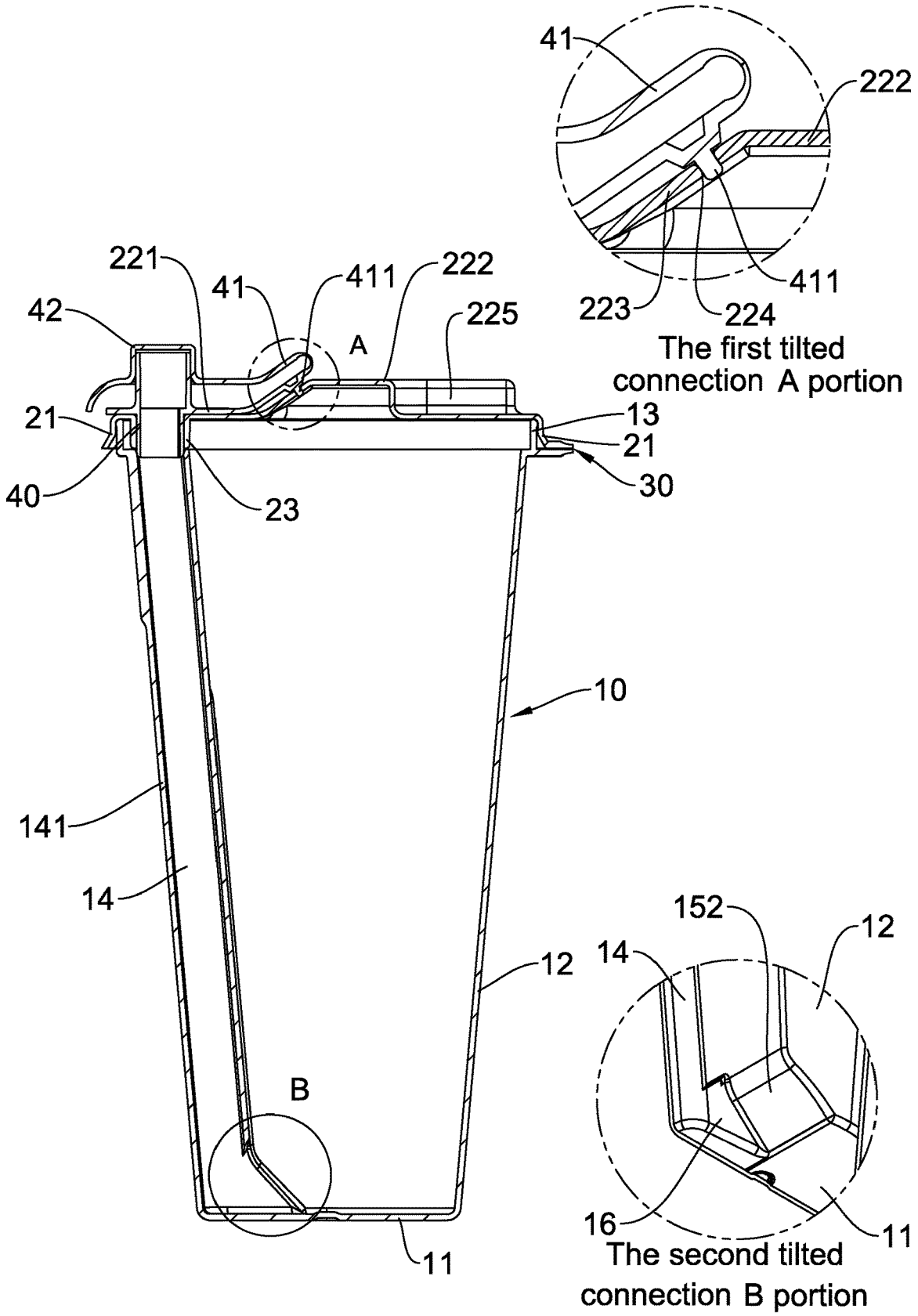
FIG. 3 is a cross sectional view showing the assembly of the recyclable takeaway cup according to the preferred embodiment of the present invention.

Referring to FIGS. 1-3, the body 10 includes a lower edge 11, an enlarged fringe 12 extending upward from the lower edge 11, a mouth 13 formed on a top of the enlarged fringe 12, a conduit 14 defined on an inner wall of the enlarged fringe 12, a recessed face 15 formed on the enlarged fringe 12 beside two ends of the conduit 14, and an inlet 16 defined between the conduit 14 and the lower edge 11. The recessed face 15 has a first tilted connection portion 151 formed on a top thereof, and the recessed face 15 has a second tilted connection portion 152 formed on a bottom thereof, wherein the first tilted connection portion 151 extends upward to the enlarged fringe 12 from the top of the recessed face 15, and the second tilted connection portion 152 extends to the lower edge 11 from the bottom of the recessed face 15. As shown in FIG. 3, the inlet 16 is defined on a center of the second tilted connection portion 152.

Referring to FIGS. 1-3, to view a capacity and ingredients in the body 10, the conduit 14 has a window 141 fixed adjacent to the enlarged fringe 12 and made of transparent or translucent material.

As shown in FIGS. 1-3, the body 10 and the lid 20 are one-piece connected via the flexible connection unit 30, and the flexible connection unit 30 is bendable in a U shape so that the lid 20 is covered on the mouth 13 of the body 10. A first end of the flexible connection unit 30 is connected on a bottom of the mouth 13, and a second end of the flexible connection unit 30 is connected on a bottom of the lid 20.

As illustrated in FIGS. 1-3, the lid 20 includes a surround fence 21 configured to cover the mouth 13, a platform 33 formed on a top of the surround fence 21, an opening 23 defined on the platform 22, corresponding to the conduit 14 and configured to receive the sucking element 40. The sucking element 40 is removable and hollow so that when the lid 20 is covered on the mouth 13 of the body 10, the sucking element 40 is inserted into a top of the conduit 14 to suck the content in the body 10.

Figure 4:
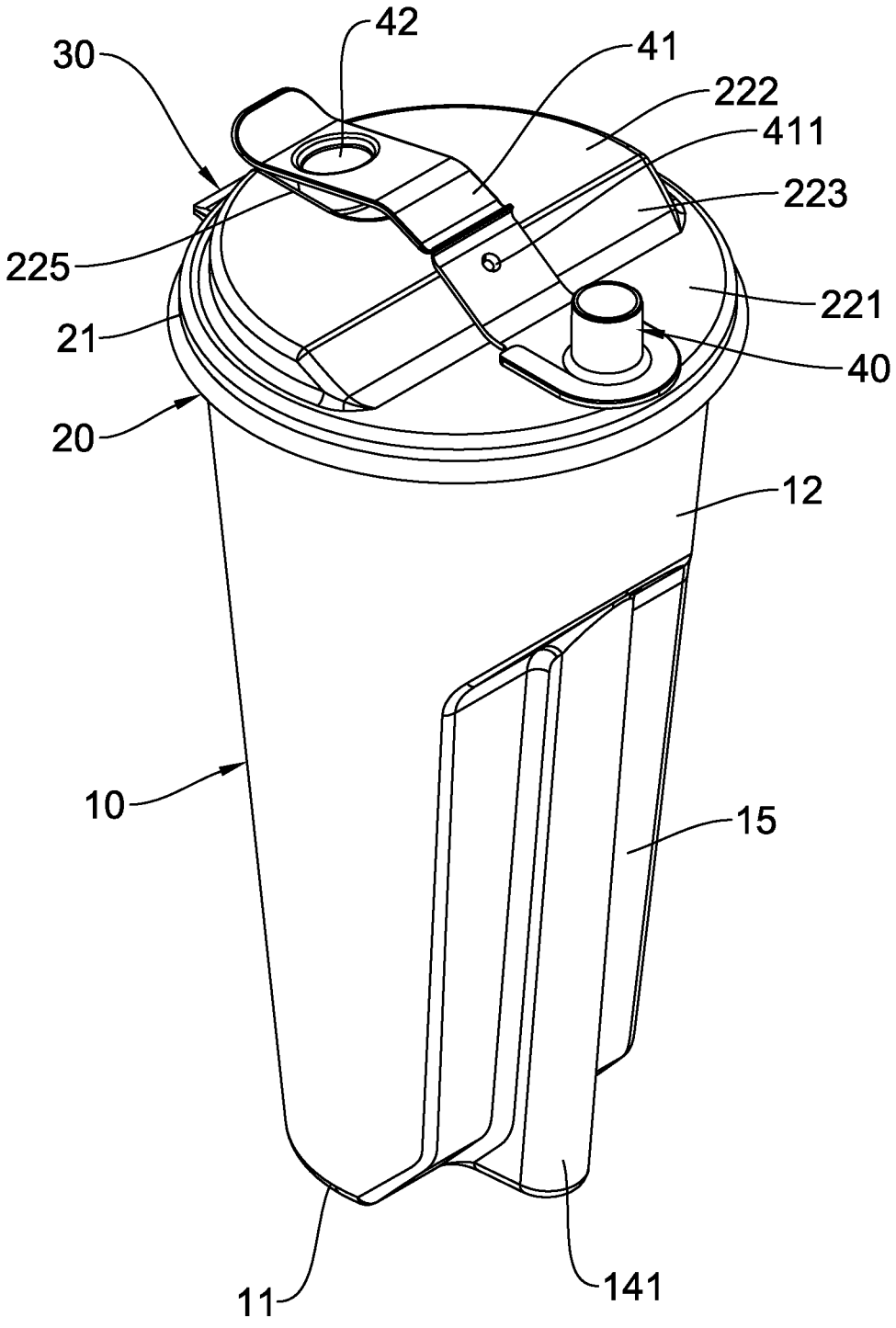
FIG. 4 is a perspective view showing the operation of the recyclable takeaway cup according to the preferred embodiment of the present invention.

With reference to FIGS. 2 and 4, the sucking element 40 includes a bendable flexibility sheet 41 connected thereon, a plug 42 connected on an end of the bendable flexibility sheet 41 and configured to close the sucking element 40. The platform 22 has a lower portion 221, a high portion 222, a beveled coupling face 223 configured to connect the lower portion 221 with the high portion 222, and an air orifice 224 defined on the beveled coupling face 223. The bendable flexibility sheet 41 has a head 411 formed on a predetermined position thereof and configured to be received in the orifice 224. The high portion 222 has an arcuate receiving portion 225 configured to receive the plug 42 when removing the plug 42 from the sucking element 40.

The body 10, the lid 20, and the flexible connection unit 30 are one-piece molded from environmentally friendly plastic material by a plastic mold, such that the recyclable takeaway cup is recycle without being removed when cleaning and recycling the recyclable takeaway cup, thus saving water and power consumption.

Figure 5:
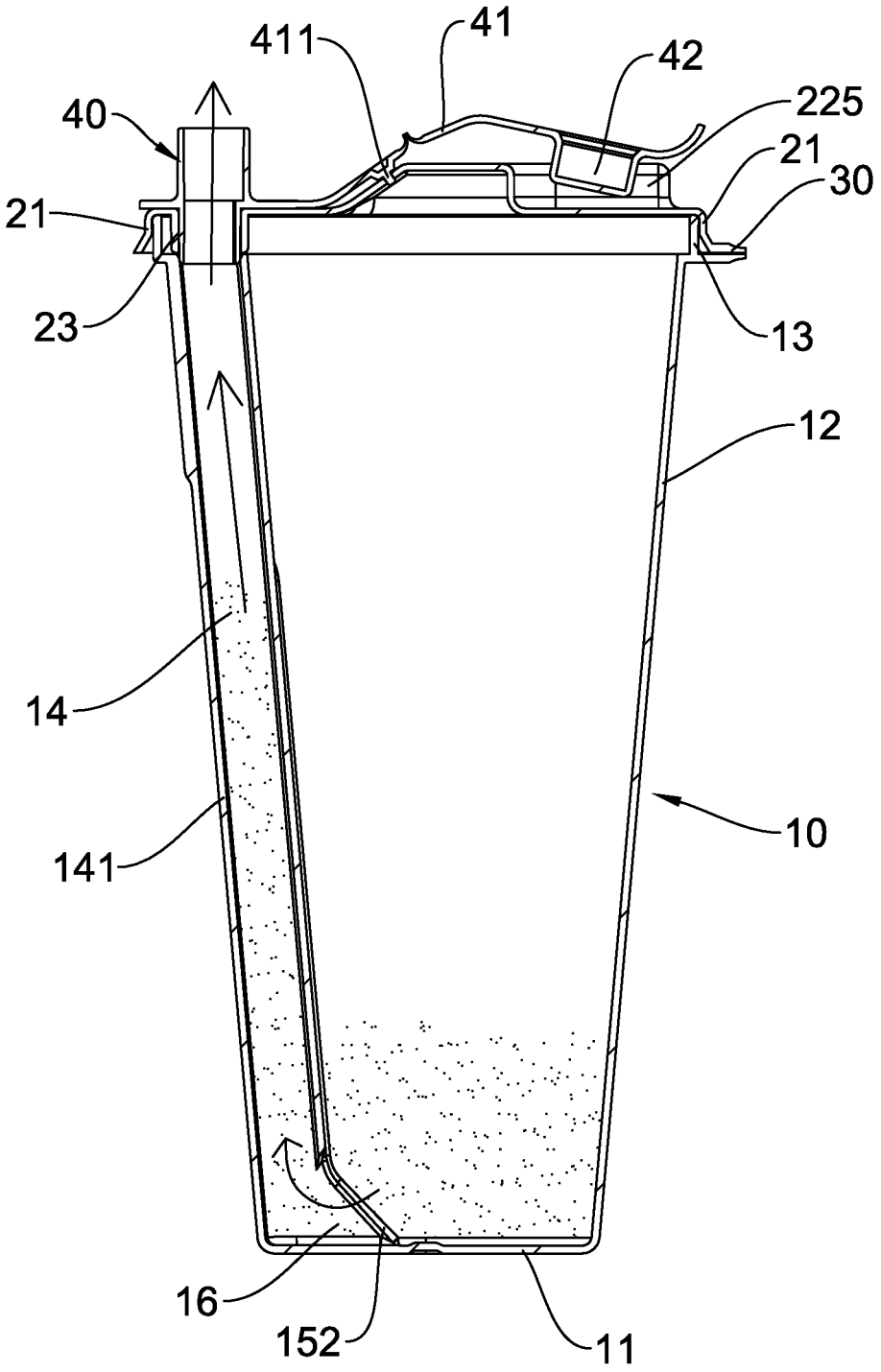
FIG. 5 is a cross sectional view of FIG. 4 according to the preferred embodiment of the present invention.

Thereby, the recyclable takeaway cup of the present invention has advantages as follows:

1) When recycling the recyclable takeaway cup, the recyclable takeaway cup is placed to recycling equipment directly, since the body 10 and the lid 20 are one-piece connected via the flexible connection unit 30, thus obtaining easy recycling.
2) Because the body 10 and the lid 20 are one-piece connected via the flexible connection unit 30, the body 10 and the cup 20 are washed together to save the water consumption.
3) The body 10, the lid 20, and the flexible connection unit 30 are one-piece molded from the environmentally friendly plastic material, thus having cleaning, drying and sterilizing operations, and recycling process one time.
4) The body 10 and the cup 20 are one-piece molded and the sucking element 40 is received in the body 10, thus simplifying material preparation, cleaning, and recycling.
5) Referring to FIGS. 4 and 5, in use, drink is accommodated in the body 10, and the lid 20 is covered on the mouth 13, thus obtaining easy drinking. Preferably, the sucking element 40 is configured to suck drinks in the body 10 via the conduit 14, and the ingredients in the body 10 are viewable via the window 141, thus enhancing drinking pleasure. Also, the cup is one-piece connected with the body, thereby eliminating a seal film on the body and obtaining dustproof, leakproof and temperature maintaining purposes.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A recyclable takeaway cup comprising: a body, a lid, and a flexible connection unit;

wherein the body includes a lower edge, an enlarged fringe extending upward from the lower edge, a mouth formed on a top of the enlarged fringe, a conduit defined on an inner wall of the enlarged fringe, a recessed face formed on the enlarged fringe beside two ends of the conduit, and an inlet defined between the conduit and the lower edge;

wherein the body and the lid are one-piece connected via the flexible connection unit, and the flexible connection unit is bendable in a U shape so that the lid is covered on the mouth of the body, wherein a first end of the flexible connection unit is connected on a bottom of the mouth, and a second end of the flexible connection unit is connected on a bottom of the lid; and wherein the lid includes a surround fence configured to cover the mouth, a platform formed on a top of the surround fence, an opening defined on the platform, corresponding to the conduit and configured to receive a sucking element, wherein the sucking element is removable and hollow so that when the lid is covered on the mouth of the body, the sucking element is inserted into a top of the conduit to suck ingredients in the body;

wherein the recessed face has a first tilted connection portion formed on a top thereof and extending upward to the enlarged fringe.

2. The recyclable takeaway cup as claimed in claim 1, wherein the recessed face has a second tilted connection portion formed on a bottom thereof and extending to the lower edge, wherein the inlet is defined on a center of the second tilted connection portion.

3. The recyclable takeaway cup as claimed in claim 1, wherein the conduit has a window fixed adjacent to the enlarged fringe and made of transparent or translucent material.

4. The recyclable takeaway cup as claimed in claim 1, wherein the sucking element includes a bendable flexibility sheet connected thereon, a plug connected on an end of the bendable flexibility sheet and configured to close the sucking element; wherein the platform has a lower portion, a high portion, a beveled coupling face configured to connect the lower portion with the high portion, and an air orifice defined on the beveled coupling face; the bendable flexibility sheet has a head formed on a predetermined position thereof and configured to be received in the orifice; the high portion has an arcuate receiving portion configured to receive the plug, when removing the plug from the sucking element.

5. The recyclable takeaway cup as claimed in claim 1, wherein the body, the lid, and the flexible connection unit are one-piece molded by a plastic mold.

* * * * *